United States Patent [19]

Cutler

[11] 4,032,416

[45] June 28, 1977

[54] ELECTROLYTIC OXIDATION PROCESS

[75] Inventor: Leonard Harry Cutler, Wilmington, Del.

[73] Assignee: E. I. Du Pont de Nemours and Company, Wilmington, Del.

[22] Filed: Mar. 10, 1976

[21] Appl. No.: 665,550

[52] U.S. Cl. ..... 204/79; 204/292

[51] Int. Cl.[2] ..... C25B 3/02; C25B 11/04

[58] Field of Search ..... 204/72, 79, 292

[56] References Cited

UNITED STATES PATENTS 2,385,410 9/1945 Gardner ..... 204/72

3,313,717 4/1967 Kowata et al. ..... 204/79

*Primary Examiner*—R. L. Andrews

[57] ABSTRACT

Dialkyldithiocarbamates are electrolytically oxidized to tetraalkylthiuram disulfides in a direct current electrolytic cell divided into a cathode compartment and an anode compartment separated from each other by a cationic membrane. The anode is stationary and has active surfaces of shiny platinum. Tetraalkylthiuram disulfides are obtained in high yield and in high degree of purity. The product tetraalkylthiuram disulfides are useful as vulcanization accelerators, fungicides, and seed treating agents.

15 Claims, 1 Drawing Figure

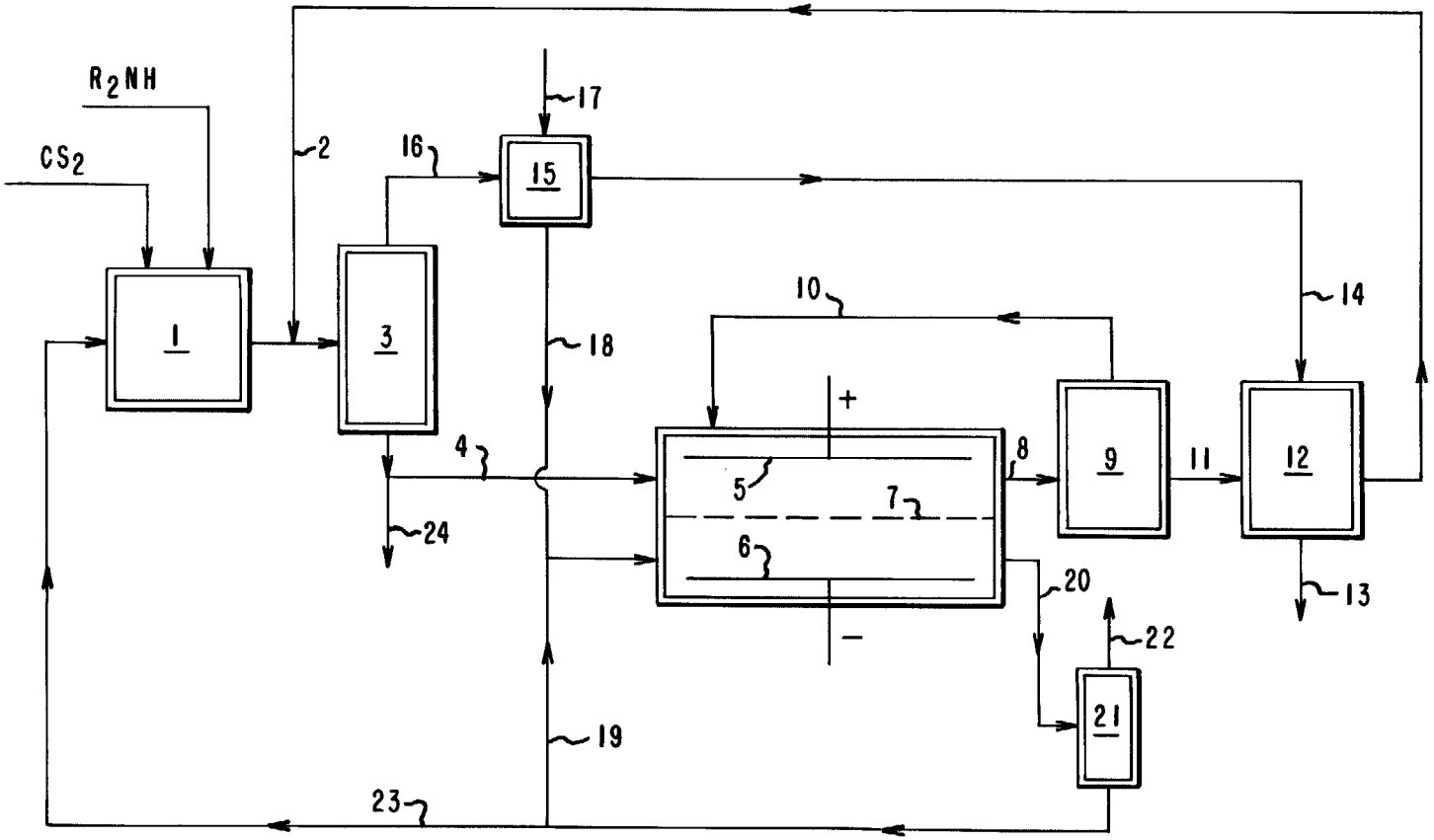
R2NH
CS2
1
2
3
4
5
6
7
8
9
10
11
12
13
14
15
16
17
18
19
20
21
22
23
24
+
−

ELECTROLYTIC OXIDATION PROCESS

BACKGROUND OF THE INVENTION

This invention relates to a process for the electrolytic oxidation of sodium dialkyldithiocarbamates to tetraalkylthiuram disulfides.

Tetraalkylthiuram disulfides are commerically important in industry and agriculture as, for example, vulcanization accelerators, fungicides, and seed treating agents. The usual industrial method of making these compounds involves oxidation of dialkyldithiocarbamates with chlorine. Because of overoxidation, which cannot be avoided, the yield of the chlorine oxidation process does not exceed about 88%. The overoxidation products, large quantities of sodium chloride, and a small amount of the thiuram disulfide are removed in the waste stream.

Electrolytic oxidation of dialkyldithiocarbamates to tetraalkylthiuram disulfides theoretically appears to be a much better alternative since it should be capable of producing purer product in a higher yield and would not present as environmentally serious waste disposal problems as does the chlorine oxidation method. The electrochemical reaction has been attempted in the past but without much success. Thus, U.S.S.R. Pat. No. 53,766 (1938) discloses a process for the continuous electrolysis of sodium dimethyldithiocarbamate using a scraped, rotating nickel anode. A thin sheet of asbestos is inserted between the anode and the cathode, but its purpose is not explained in the patent. The necessity of using a rotating anode is a serious shortcoming of this process because it usually is difficult to maintain good chemical contact between a rotating electrode and the source of electrical current. Apparently the combination of rotating anode and scraper, which removes the product, avoids excessive build-up of the product on the anode.

U.S. Pat. No. 2,385,410 (1945) describes an electrolytic process using alternating current to avoid deposition of the product on the electrodes. Direct current electrolysis requiring scraped electrodes is said to be awkward and inconvenient. The product appears, however, to have been obtained in low yield and in a state of questionable purity. Because, according to the patentee, a neutral medium is preferred, pH control is important. Acid is added gradually to the cell to neutralize caustic generated during the electrolysis.

It can be seen that the electrochemical production of tetraalkylthiuram disulfides from dialkyldithiocarbamates has not lived up to the expectations, and that an improved process would be very desirable.

SUMMARY OF THE INVENTION

The present invention provides an improved process for a direct current electrolytic oxidation of dialkyldithiocarbamates to tetraalkylthiuram disulfides, wherein the electrolytic cell is divided into the cathode compartment and the anode compartment separated from each other by a cationic membrane capable of resisting migration of hydroxyl ions under the electrolysis conditions. The only active anode surfaces exposed to the anolyte are shiny platinum surfaces; the anolyte is an alkali metal dialkyldithiocarbamate solution; and the catholyte is a dilute alkali solution.

It is preferred to operate the process of this invention at an anode current density of at least 0.2 amp/cm$^2$ at sodium dialkyldithiocarbamate concentration of 20–40 weight percent, and at anolyte temperature of at least 60° C.

THE DRAWING

The drawing schematically represents a complete process flow sheet for a typical plant unit according to the present invention.

DETAILED DESCRIPTION OF THE INVENTION

The chemical reactions occurring in an electrolytic cell according to this invention are represented by the following equations:

Anode:

$$2\ R_2NC(=S)Na \longrightarrow R_2NC(=S)SC(=S)NR_2 + 2Na^+ + 2e$$

Cathode:

$$2\ Na^+ + 2H_2O + 2e \longrightarrow 2NaOH + H_2$$

Because of the cationic membrane separating the electrode compartments, sodium hydroxide formed at the cathode cannot enter the anode compartment and increase the alkalinity of the anolyte. Because of this feature, the process of the present invention does not require neutralization of the anolyte which was necessary in the process of the above-discussed U.S. Pat. No. 2,385,410.

Another problem which plagued prior attempts was product build-up on the anode. It has now been unexpectedly discovered that shiny platinum is the only active anode material which is not subject to product build-up, especially if the anolyte is agitated. It is not necessary that the entire anode be made of shining platinum, such as foil or wire, but it can also be made by rolling a layer of platinum on a suitable substrate, such as, for example, titanium, tantalum, and columbium. These metals are passive in contact with the annolyte and will not cause product accumulation.

The cathode may be made of any suitable material. The most commonly used cathode material is mild steel. Other possible materials include, for example, stainless steel and titanium. While precious metals such as platinum, gold, iridium, or palladium, also are suitable cathode materials, their high cost makes them impractical for this application.

With presently available cationic membranes, the sodium hydroxide concentration in the cathode compartment preferably should not be higher than 17 weight percent. Above this concentration, the cationic membrane would lose selectivity sufficiently and would allow hydoxyl ions into the anode compartment in amounts which would alter the pH and bring about the formation of undesirable by-products. However, as membranes which still are selective at high caustic concentrations become available, such higher concentrated caustic can be used. The catholyte is continuously diluted by water because each $Na^+$ ion going through the cationic membrane is accompanied by about twelve water molecules. The number of molecules of water that pass through the membrane for each $Na^+$ ion depends on the membrane used. Additional water may be added, if desired, directly to the catholyte continuously or intermittently. Excess catholyte usually will be drained.

While under the preferred conditions the anolyte temperature is at least 60° C, the catholyte temperature may be lower or higer. Usually, there will be a difference of a few degrees between the electrolytes in both compartments.

The discovery that shiny platinum is the only suitable active anode surface material is surprising because other metals can be obtained in the same degree of surface smoothness and are as inert chemically, yet are unsuitable. These include, for example, gold, nickel and stainless steel. It is not certain whether material build-up encountered with such materials in prior art processes is due to the fact that impure, sticky product is formed which tends to adhere to the anode surface; or, conversely, the product which builds up on the anode is eventually decomposed in part and thus is of inferior quality. The product obtained by the process of the present invention is, however, white and has a high melting point; it is a high purity material.

While the present disclosure is mainly concerned with the electrolysis of sodium dialkyldithiocarbamates, other dialkyldithiocarbamate salts can be used in this process. These would be especially potassium and lithium salts but may also be other alkali metal, ammonium, and quaternary ammonium salts.

The cationic membrane required in the process of the present invention can be any commercially available, organic or inorganic membrane, such as, for example, a Nafion cationic membrane available from E. I. du Pont de Nemours and Company, Wilmington, Delaware.

The preferred dialkyldithiocarbamate concentration in the anode compartment provides maximum current efficiency. A 30% solution has the highest conductivity. The conductivity of solutions more dilute than 20% may be too low for practical operation; above 40%, a slurry is formed and the conductivity is quite low. In addition, outside the preferred concentration limits danger of overoxidation arises. The desired current efficiency is at least about 90%. The "inefficient"current may produce either innocuous products such as hydrogen and oxygen from electrolytic decomposition of water or tetraalkylthiuram disulfide degradation products, which should be avoided.

The process of this invention can be run with a direct current of constant polarity, or the direction of current may be periodically reversed for short time intervals. In practice the current reversal will not normally be required.

Referring now to the drawing, the process of the present invention can be operated according to the flow sheet therein.

A dialkylamine, carbon disulfide and recycled sodium hydroxide are combined to form sodium dialkyldithiocarbamate in the "salt reactor" 1. To the product from this reactor is added filtrate and wash water 2 from the final product isolation steps so that unchanged dithiocarbamate can be recovered. These streams are heated in an evaporator 3 and enough water is evaporated to give a feed stream 4 to the electrolysis cell anode compartment of the desired dithiocarbamate concentration. Since impurities built up in the recycle streams will be at the highest concentration in this stream, a purge 24 is provided here so that impurity levels will equilibrate. The dithiocarbamate solution is electrolyzed in the anode compartment 5 of the electrolytic cell which is separated from the cathode compartment 6 by a cationic membrane 7. The effluent from the anode compartment 8 contains precipitated tetraalkylthiuram product. Solids in this effluent stream are concentrated in a settling tank 9 to give dialkyldithiocarbamate solution for recycle 10 and a more concentrated slurry of product tetraalkylthiuram disulfide 11. The slurry is filtered and washed with water in filter 12 to give a wet filter cake product 13. The filtrate and wash water 2 are recycled as described above. The wash water 14 is provided from water storage tank 15. This tank is supplied by the water evaporated from the evaporator 16 and needed make-up water 17. This water supply also furnishes the make-up water for the catholyte 18 which enters the cathode compartment 6 along with recycled caustic solution 19. Effluent from the cathode compartment 20 is degassed in liquid-gas separator 21 to give by-product hydrogen 22 and caustic for recycle as catholyte 19 and for use in the salt reactor 23. The caustic solution recycled to the cathode compartment contains at most 17% by weight of sodium hydroxide.

This scheme makes a very neat process in which the only outflows from the process are the wet cake product 13, by-product hydrogen 22 and a small liquid purge stream 24.

This process offers the following advantages:

1. A white, high-purity thiuram product is obtained electrochemically.
2. Anode scraping devices are not needed so that standard electrochemical processing equipment can be used.
3. The sodium hydroxide generated at the cathode is of a high quality and can be recycled to the reactor where the sodium dithiocarbamate salt is formed.

This invention is now illustrated by the following examples of certain representative embodiments thereof, where all parts, proportions, and percentages are by weight unless otherwise indicated.

EXAMPLE 1

A glass electrolysis cell with two 300 ml. compartments separated by a Nafion Type 427 cationic membrane was fitted with two 10 $cm^2$ electrodes made of 5 mil platinum foil. To the anode compartment was added 300 mil of aqueous solution containing 137 grams of sodium dimethyldithiocarbamate (40% dithiocarbamate). The catholyte was 300 ml of 0.49N sodium hydroxide. A current of 3 amp was passed through the cell for one hour while the anolyte and catholyte were magnetically stirred. At the end of this time the anolyte was filtered, and pure, white tetramethyl thiuram disulfide with a melting point of 148.8° C was recovered. Conversion of the sodium dimethyldithiocarbamate was about 10%. Current efficiency was 88.5%. Product did not adhere to the anode during this operation. The temperature of the anolyte was measured as 64° C toward the end of the operation. By material balance, 95.5% of the electrolyzed dithiocarbamate was accounted for as the tetramethylthiuram product recovered.

EXAMPLE 2

This comparative experiment was carried out under the same conditions as Example 1 except that a single 300 ml beaker housed both electrodes. No membrane was used in the cell. The beaker was charged with 300 ml of sodium dimethyldithiocarbamate solution. A 3 amp current was passed through the cell for one hour while the soluton was magnetically stirred. At the end of this time the solution was filtered to give 2.4 grams of product when dry. This is equivalent to 2.1% conversion of the dithiocarbamate present and a current efficiency of about 18%.

EXAMPLE 3

Conditions of Example 1 were reproduced except that a 2.5 amp current was passed through the cell for four hours. A pure white product (35.1 g) was obtained which had a melting point of 145° C. Current efficiency was 78.3%. Conversion of sodium dimethyldithiocarbamate was about 25%. Thus good product was produced in Exmaples 1 and 3 at high current efficiencies at 0.25 and 0.30 amp/cm² current densities.

EXAMPLE 4

Conditions of Example 3 were repeated except that the temperature was not allowed to rise to the usual 60–90° C. With an ice bath around the anolyte, the temperature was maintained at 20°28° C. After a 2.5 amp current was passed for 4 hours, 14.55 g of a yellow product was recovered by filtration and drying. Current efficiency was only 32.5%. This shows the undesirability of operating the electrochemical cell at a temperature well below the stated minimum temperature.

EXAMPLE 5

The same apparatus and electrolyte solutions as used in Examples 1, 3 and 4 were used here. A lower current of 1 amp was passed for 4 hours. This resulted in 6.21 g. of impure product with a melting point of 132° C. Current efficiency was only 34.7%. It appears desirable to operate at current densities of 0.2 amp/cm² or greater for satisfactory cell operation rather than at the lower current density (0.1 amp/cm²) of this example.

EXAMPLE 6

The same conditions as shown in Example 1 were used here. A 3 amp current was passed for 2 hours giving 23.5 g of a white product. Anolyte temperature toward the end of cell operation was about 76° C. Current efficiency was 87.4%.

EXAMPLE 7

The same apparatus and conditions used in Example 6 were used here except that only 27.4 g. of sodium dimethyl dithiocarbamate were in the anolyte. Thus the solution was only 8% dithiocarbamate by weight rather than the 40% normally used. After a 3 amp current was passed through the cell for 2 hrs, 5.9 g. of a yellow product were recovered. Anolyte temperature had reached 90° C. The current efficiency was only 21.9%.

I claim:

1. A process for the electrolytic oxidation of a dialkyldithiocarbamate to a tetraalkylthiuram disulfide, said process comprising 1. introducing a catholyte and an anolyte to an electrolytic cell divided into a cathode compartment and an anode compartment separated from each other by a cationic membrane capable of resisting migration of hydroxyl ions under process conditions, the active anode surfaces being shiny platinum; the anolyte being an aqueous solution of an alkali metal dialkyldithiocarbamate, and the catholyte being a dilute aqueous alkali solution;
2. connecting the anode and the cathode to a direct current source of a high enough voltage to provide a current density sufficient to effect oxidation of the dialkyldithiocarbamate to tetraalkylthiuram disulfide; and
3. recovering the tetraalkylthiuram disulfide from the anode compartment.

2. The process of claim 1 wherein the catholyte is a solution of at most 17 weight percent sodium hydroxide; the anolyte is a solution of a 20–40 weight percent sodium dialkyldithiocarbamate; the anolyte temperature is at least about 60° C; and the current density is at least about 0.2 amp/cm² .

3. The process of claim 2 wherein the anolyte is agitated.

4. The process of claim 3 wherein the dialkyldithiocarbamate is dimethyldithiocarbamate.

5. The process of claim 1 wherein the anode has, in addition to the active shiny platinum surfaces, also passive surfaces of titanium, tantalum, or columbium.

6. The process of claim 5 wherein the catholyte is a solution of at most 17 weight percent sodium hydroxide; the anolyte is a solution of a 20–40 weight percent sodium dialkyldithiocarbamate; the anolyte temperature is at least about 60° C; the current density is at least about 0.2 amp/cm²; and the anolyte is agitated.

7. The process of claim 6 wherein the dialkyldithiocarbamate is dimethyldithiocarbamate.

8. The process of claim 1 wherein the dialkyldithiocarbamate salt is sodium salt, and it is present in a concentration of about 20–40 weight percent of the anolyte.

9. The process of claim 1 wherein the anode current density is at least 0.2 amp/cm², and the anolyte temperature is at least about 60° C.

10. The process of claim 1 wherein the anolyte is agitated.

11. A process for the production of tetraalkylthiuram disulfides, wherein in the first stage a dialkylamine, carbon disulfide, and part of effluent sodium hydroxide from the cathode compartment of an electrolytic cell divided into a cathode compartment and an anode compartment by a cationic membrane capable of resisting migration of hydroxyl ions under the electrolysis conditions, the active surfaces of the anode being shiny platinum, are combined to form aqueous sodium dialkyldithiocarbamate in a reactor; sodium dialkyldithiocarbamate solution about 20–40 weight percent is fed to the anode compartment of said electrolytic cell; aqueous sodium hydroxide is introduced to the cathode compartment; direct current is applied to the electrodes, the anode current density being at least about 0.2 amp/cm²; the solids in the effluent from the anode compartment, which contains the precipitated tetraalkylthiuram disulfide, are concentrated to give dialkyldithiocarbamate solution for recycle and a concentrated slurry of product tetraalkylthiuram disulfide; the slurry is filtered and washed with water; the filtrate and wash water are combined with the dialkyldithiocarbamate product from the reactor; and effluent from the cathode compartment is degassed to give hydrogen and caustic, the caustic being recycled in part to the cathode compartment and in part to said reactor.

12. The process of claim 11 wherein the dialkyldithiocarbamate is dimethyldithiocarbamate.

13. The process of claim 11 wherein the anolyte temperature is at least about 60° C and the anolyte is agitated.

14. The process of claim 11 wherein the anode has, in addition to its active shiny platinum surfaces, also inactive of titanium, tantalum, or columbium.

15. The process of claim 11 where the concentration of sodium hydroxide in the cathode compartment is at most about 17 weight percent.

* * * * *